United States Patent [19]

Reis

[11] 3,946,781

[45] Mar. 30, 1976

[54] CREDIT CARD BILLFOLD AND A FLEXIBLE CARD PROTECTING FLAP

[75] Inventor: John P. Reis, West Bend, Wis.

[73] Assignee: Amity Leather Products Co., West Bend, Wis.

[22] Filed: Apr. 25, 1975

[21] Appl. No.: 571,735

[52] U.S. Cl. ..... 150/35; 150/39

[51] Int. Cl.[2] ..... A45C 11/18

[58] Field of Search ..... 150/39, 35; 229/72; 40/104.19, 124.2

[56] References Cited

UNITED STATES PATENTS

| | | | |
|---|---|---|---|
| 1,797,279 | 3/1931 | Witchger | 150/39 UX |
| 2,219,511 | 10/1940 | Coolbroth | 150/35 |
| 2,452,096 | 10/1948 | Bertalotto | 150/35 |
| 2,886,907 | 5/1959 | Stephenson | 40/124.2 |
| 3,759,305 | 9/1973 | McIntyre | 150/39 |
| 3,777,795 | 12/1973 | Graetz | 150/39 X |

FOREIGN PATENTS OR APPLICATIONS

| | | | |
|---|---|---|---|
| 120,832 | 7/1971 | Denmark | 229/72 |

*Primary Examiner*—Donald F. Norton
*Attorney, Agent, or Firm*—James E. Nilles

[57] ABSTRACT

A billfold or wallet for carrying a plurality of credit cards or the like in readily accessible position including a flexible flap member protecting the cards. The wallet includes a pair of plastic liners each forming a plurality of separate pockets for receiving credit cards therein, and a flexible flap covering the pockets in order to protect the credit cards located therein from abrasive wear and to prevent the credit cards from inadvertently slipping out of the wallet. The flexible flap is made from a thin, transparent plastic material so that the cards may be easily selected, and the flap is secured in such a manner as to facilitate removal or insertion of the credit cards.

9 Claims, 8 Drawing Figures

CREDIT CARD BILLFOLD AND A FLEXIBLE CARD PROTECTING FLAP

BACKGROUND OF THE INVENTION

Multiple card wallets or billfolds have been proposed wherein means are provided for holding a plurality of credit cards in overlapping, shingled relationship, each of said cards being positioned in a separate pocket. The purpose of such an arrangement is to make the credit cards readily accessible to facilitate their selection and to facilitate reinsertion of the card into the wallet without it being obstructed by other items in the wallet. Multiple card wallets of this type are shown, for example by the patent to Dengel, U.S. Pat. No. 3,856,063, issued Dec. 24, 1974.

The present invention provides an improvement over the prior art wallets or billfolds by including a flexible flap means to cover the cards positioned in the separate pockets in order to prohibit the possibility that one of the cards may inadvertently fall out of the wallet and to prevent undue abrasive wear of the cards.

SUMMARY OF THE INVENTION

The present invention provides a billfold or wallet which includes at least one multi-pocket liner having a plurality of individual pockets for receiving credit cards in shingled relation and includes a flexible flap member which covers the credit cards to guard the cards from abrasive wear and to prevent the cards from inadvertently slipping out of their respective pockets.

The flexible flap may be constructed from a transparent material such that the cards in the pockets are readily visible through the flap and thus easily selected, and the flexible flap is attached to the wallet in such a manner that it may be conveniently lifted away from the cards contained in the pockets to facilitate removal or insertion of a card.

DESCRIPTION OF THE PREFERRED EMBODIMENTS

Figure 1:
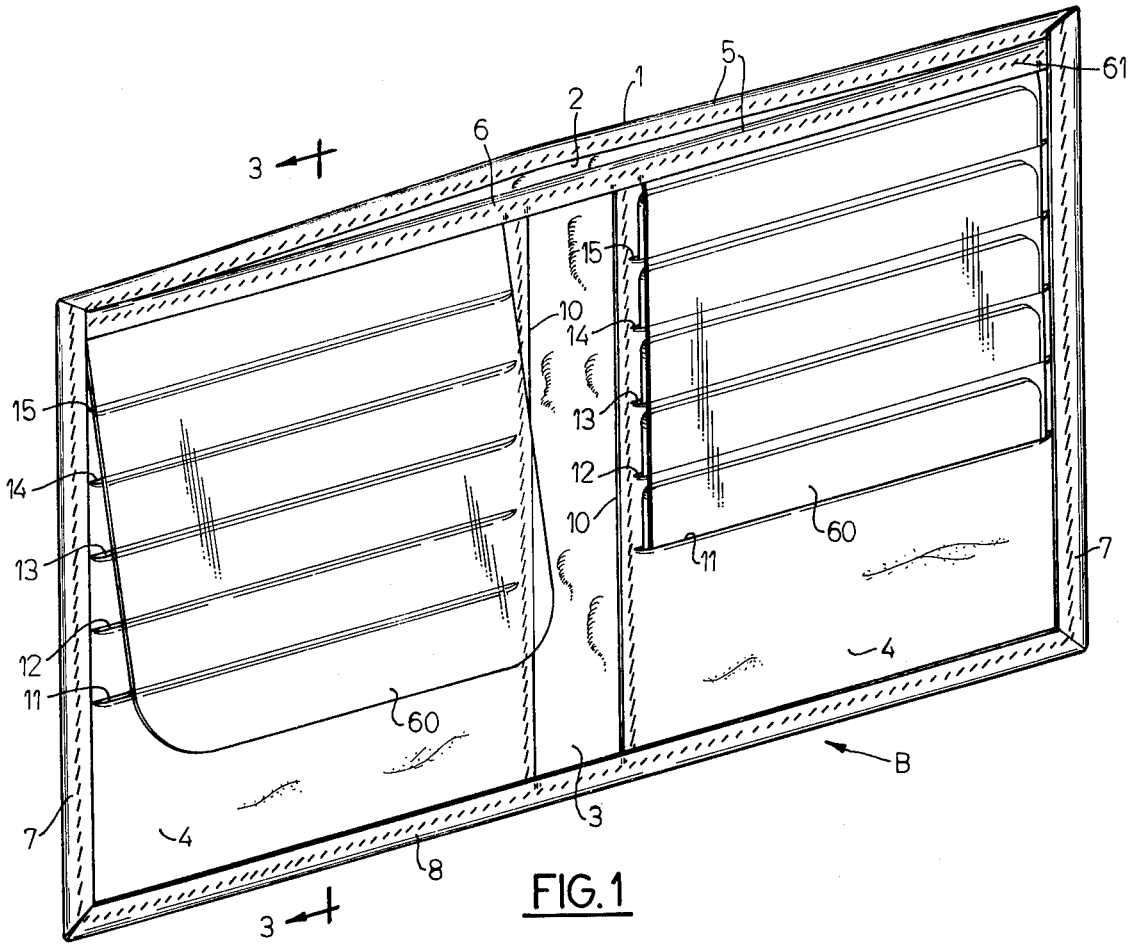
FIG. 1 is a perspective view of a billfold embodying the present invention, the view being taken generally from the inside of the billfold.
Figure 3:
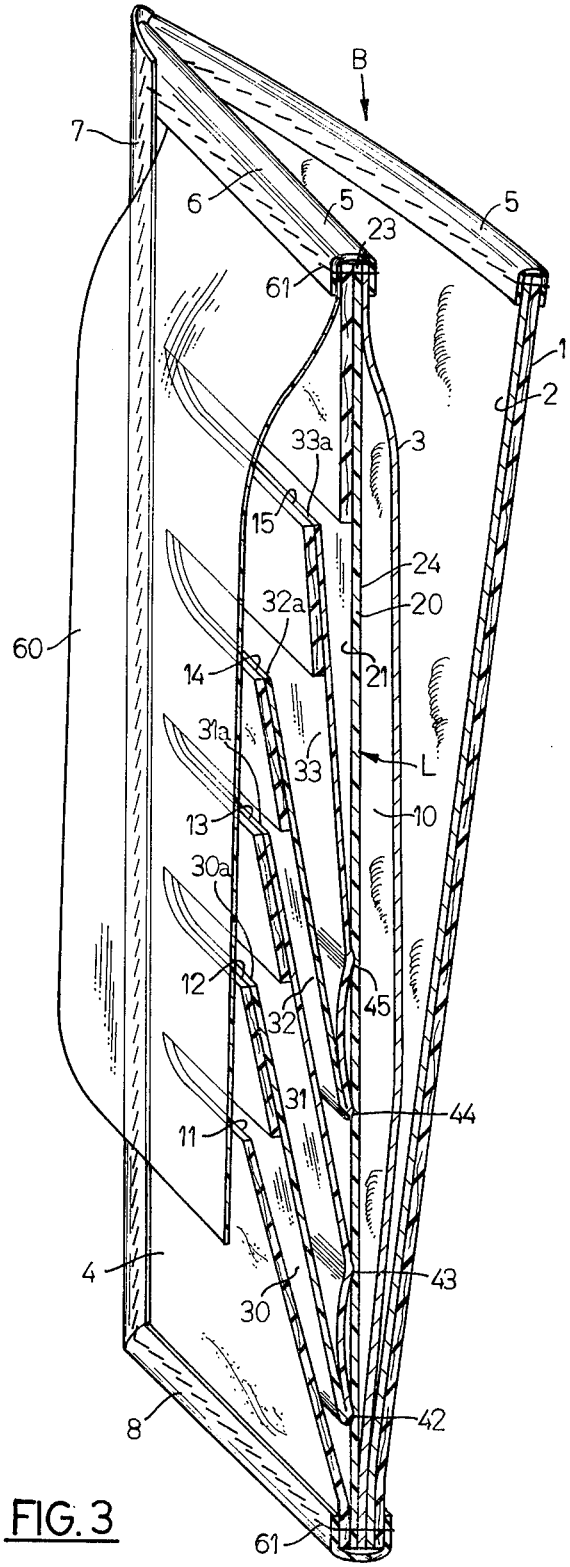
FIG. 3 is a section view taken along the line 3—3 in FIG. 2, but on an enlarged scale and being exaggerated somewhat in that the individual pockets are pulled outwardly to show their construction.

One embodiment of the invention is shown in FIGS. 1 and 3 as embodied in a wallet or billfold B which is made generally from leather, for example, and which comprises an outside wall 1 lined with fabric 2, an inner flexible wall 3 which may be formed of fabric and a pair of flexible walls 4, also formed of leather. It will be noted that the usual edging and stitching is provided around the periphery to form a binding 5. More specifically, the binding 5 secures the wall 1 and its lining 2 together and also binds together the flexible wall 3 with each of the flexible walls 4.

The inner flexible wall 3 and the front flexible walls 4 are secured together by binding 5 around the upper side 6, the vertical side 7 and the lower side 8, thus presenting envelope-like openings 10 along the other vertical side, and, more specifically, between walls 3 and 4.

Each of the front flexible walls 4 includes a series of slits 11, 12, 13, 14, and 15 formed therein and arranged in parallelism with one another and also being spaced a vertical distance apart, generally in the nature of one-half inch. Credit cards or the like are inserted in these slits in such a manner that a portion of the credit card extends upwardly from the slit and such that they are in overlapping and shingled relationship with one another.

As shown in FIG. 3, each of the envelope-like openings 10 includes therein a one-piece, plastic multi-pocket liner L formed of heat sealable plastic. The one-piece liner L is comprised of a back member 20 having a generally rectangular shape and including a front side 21, two opposite vertical sides, an upper edge 23 and a back side 24. The plastic liner L also includes, in the illustration shown for purposes of describing the invention, four pocket members 30, 31, 32 and 33 which are also each formed of a plastic heat sealable material. Each of these pocket members is of a generally rectangular shape and has an upper edge 30*a*, 31*a*, 32*a*, and 33*a* respectively. Likewise, the pocket members each have a lower edge and opposite vertical side edges and are of sufficient size as to receive a portion of a credit card therein.

The pocket members 30, 31, 32 and 33 are arranged in a stacked relationship against the front side 21 of the back member 20, and heat sealed together along their vertical edges and also along the bottom edges by means of heat seal lines 42, 43, 44 and 45.

The upper edges 30*a*, 31*a*, 32*a* and 33*a* of the pocket members are arranged in overlapping and shingled relationship and are secured by cement to the front wall 4 in respective alignment with the slits 12, 13, 14, and 15. The pocket liner L is also secured along its edges between the flexible walls 3 and 4, for example, by the stitching 61 through the binding 5. The result of the above construction is a series of single edge pockets arranged in shingled relation for the acceptance of cards in overlapped and readily accessible relationship.

Figure 2:
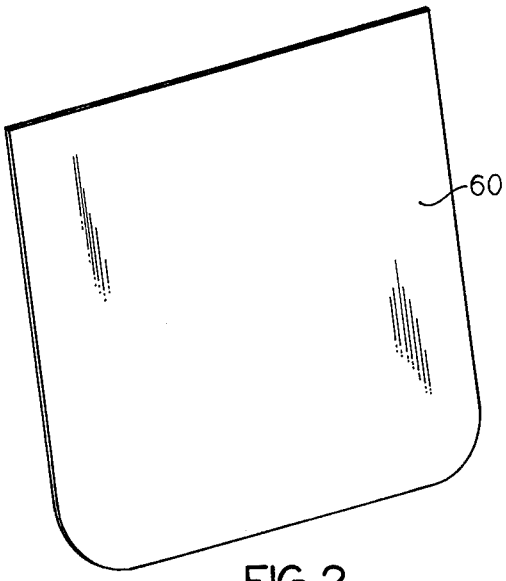
FIG. 2 is a perspective view of the flexible flap member used in the embodiment of FIG. 1.

The billfold B of the present invention also includes a pair of generally rectangular flexible members 60 shown in FIG. 2, each secured by the stitching 61 so as to extend downwardly from the binding 5 of the upper side 6 to cover the front flexible walls 4 and the credit cards projecting from the slits 11 - 15. As shown in FIGS. 1 and 3, the flexible flap member 60 is secured only along its top edge so that it may be lifted upwardly and away from the front flexible wall 4 for removal or insertion of a credit card into one of the slits 11 – 15. It is generally desirable to construct the flexible members 60 from transparent plastic material such as dry vinyl or polypropinol which does not obscure view of the cards. Such a transparent plastic material may be of a thickness on the order of 0.010 inches to provide the desired strength, but to remain relatively flexible. The flexible members 60 may also be constructed of other flexible wear resistant materials such as leather or fabrics.

One of the primary functions of the flexible member 60 is to prevent the credit cards from inadvertently slipping out of the pockets. As shown by the flexible member 60 covering the credit cards in the right side of the billfold in FIG. 1, the flexible member 60 may be tucked into the lower slit 11 so that it may be pulled flat against the credit cards in the slits 11 – 15 to hold them in the pockets. The flexible member also functions to prevent abrasive wear of the cards since it completely covers the exposed portion of all of the cards. Since the flexible member is made of transparent plastic, even though it functions to guard the cards, it leaves the cards visible and does not inhibit the selection of the desired card.

A particular advantage of the present invention arises from the fact that the arrangement of the flexible flap avoids any substantial increase in the cost of manufacturing the billfold due to the addition of the flap. As previously stated, the flexible flap member is attached by the stitching 61 through the binding 5 and the flexible walls 3 and 4. Since the stitching 61 is necessary regardless of the use of the flexible flap 60, the flexible flap can be incorporated during manufacture of the wallet without the addition of costly steps.

FIGS. 4 – 8 illustrate a second embodiment of the present invention. The elements of this embodiment which are common to that shown in FIGS. 1 – 3 are similarly numbered.

In the billfold shown in FIGS. 4 – 8, a pair of front flexible walls 4' are secured to the flexible wall 3' to form envelope-like pockets 10' therebetween. The front flexible walls 4' each include vertically extending slits 11', 12' and 13' which are generally parallel to each other in a horizontally spaced relation. Credit cards are inserted laterally through the slits 11'–13' to be received in individual pockets so that the cards can be arranged in overlapping, shingled relationship with one another.

Figure 4:
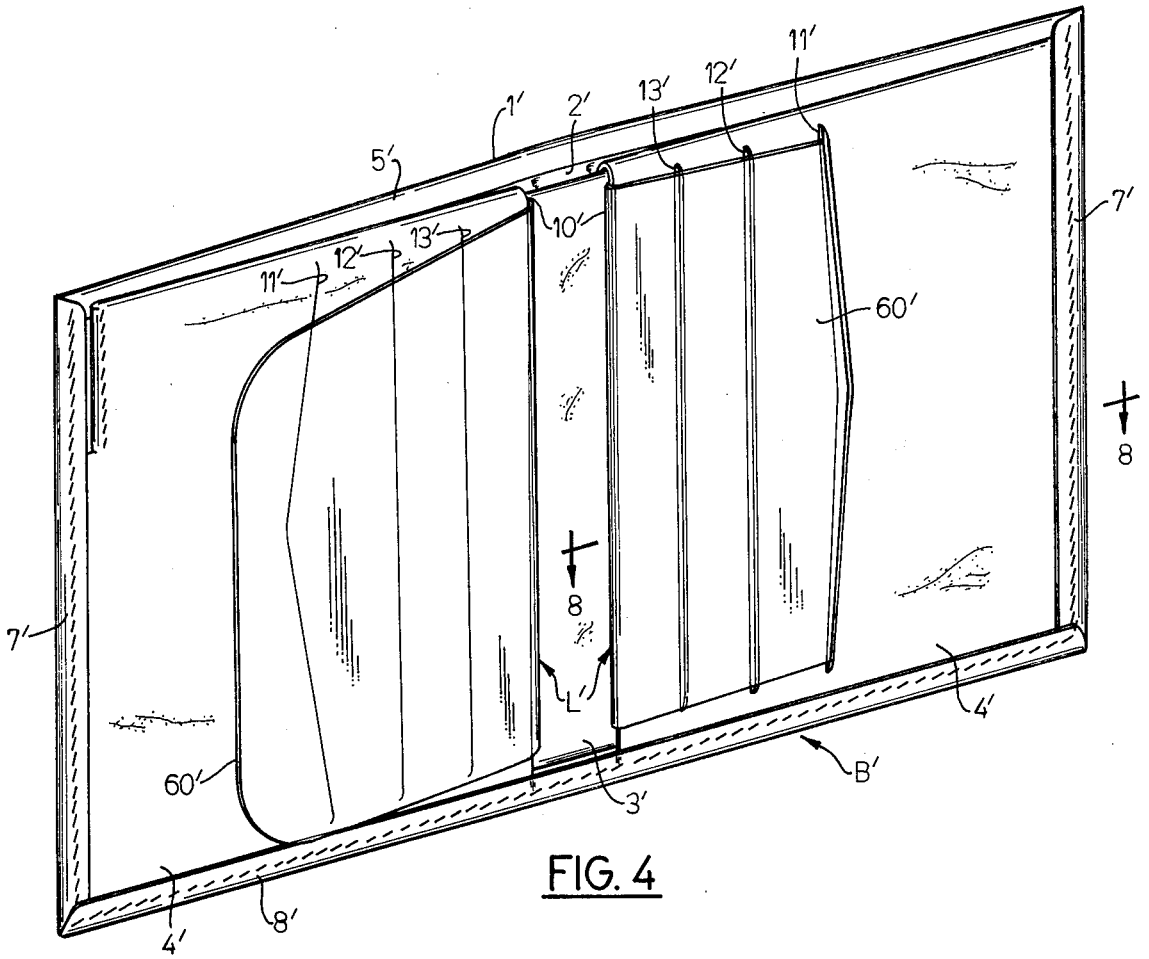
FIG. 4 is a perspective view of a billfold including a second embodiment of the present invention, the view being taken from the inside of the billfold.
Figure 5:
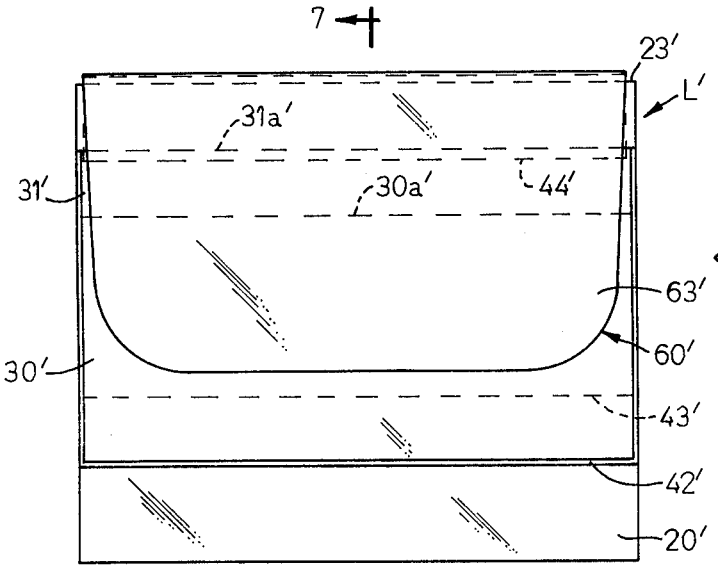
FIG. 5 is a front view of a multi-pocket plastic liner employed in the wallet shown in FIG. 4.
Figure 6:
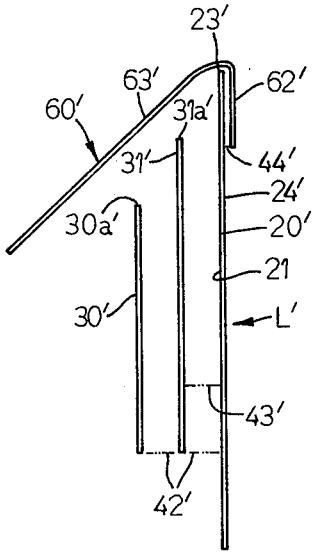
FIG. 6 is a schematic view of the plastic liner and flexible flap shown in FIG. 5 in an exploded position and before the members are secured together.
Figure 7:
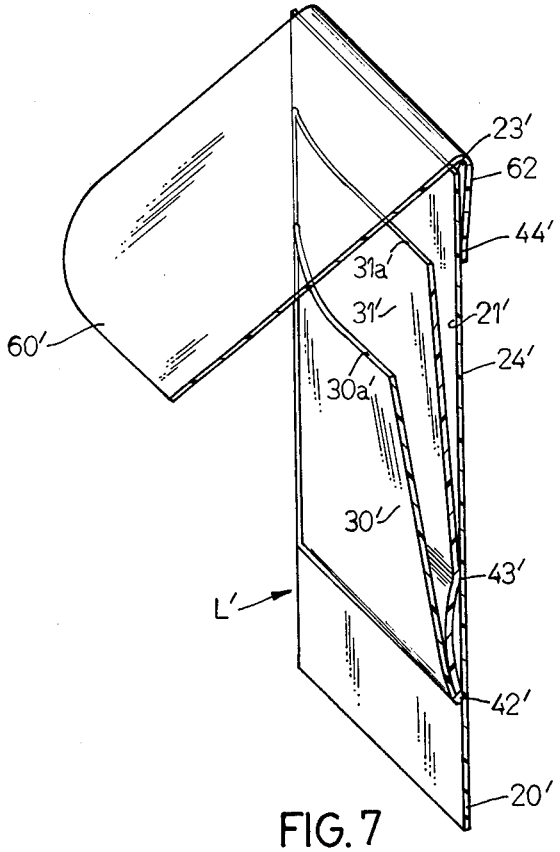
FIG. 7 is a sectional view taken along line 7—7 in FIG. 5, being somewhat exaggerated in that the individual pockets are pulled outwardly to show their construction.
Figure 8:
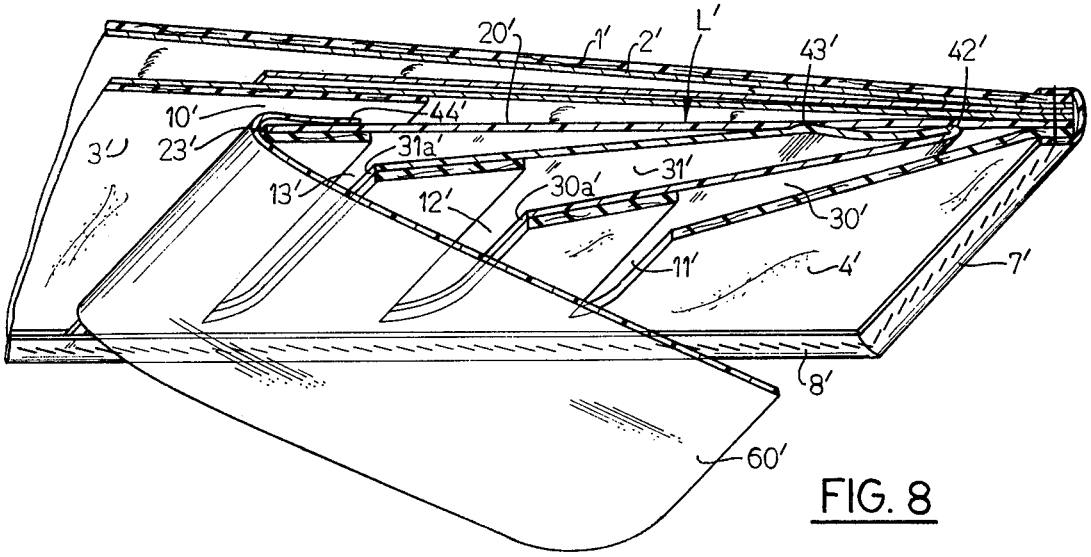
FIG. 8 is a sectional view taken along the line 8—8 in FIG. 4, but on an enlarged scale and being exaggerated somewhat in that the individual pockets are pulled outwardly to show their construction.

Each of the envelope-like pockets 10' includes a plastic multi-pocket liner L' secured therein as shown in FIG. 8. As best shown in FIGS. 5 – 7, each of the multi-pocket liners L' are comprised of a back member 20' of generally rectangular shape which has a pair of pocket members 30' and 31' secured to its front surface 21'. The pocket members 30' and 31' are heat-sealed to the back member 20' along their bottom sides at lines 42' and 43' respectively, and along their lateral sides to form pocket members each having one open edge **30*a*' and 31*a*' respectively to receive a credit card therein. As shown in FIGS. 4 and 8, the pocket liner L' is arranged in pocket 10' with the edges 30*a*' and 31*a*' of the pockets 30' and 31' aligned with the slits 12' and 13' respectively such that credit cards can be received through slits 11' – 13'** and supported by the pockets therein in shingled relationship.

The billfold of the embodiment of the invention shown in FIGS. 4 – 8 also includes a plastic transparent folded flexible member 60' which has a back flap portion 62' secured to the back portion 20' of the pocket liner L' and a front flap portion 63' which is folded around the upper edge 23' of the pocket liner L' and which is shaped to cover credit cards received in the pockets 11' – 13' and projecting therefrom. The back flap portion 62' is secured to the back portion 20', for example, by heat sealing along line 44'. The front flap portion 63' is generally of rectangular shape and covers each of the cards received in slits 11', 12' and 13'. The front flap 63' is also of such sufficient length as to be receivable in the slit 11' in such a manner that said flap is secured against each of the cards projecting from the slits. The plastic transparent flexible material comprising the folded member 60' may be, for example, dry vinyl or polypropinol having a thickness on the order of 0.010 inches. The back flap portion 62' could also be attached to the back portion 20' by stitching, or it could be made as an integral extention of back portion 20' constructed from a single piece of material.

As with the flexible flap member of the invention shown in FIGS. 1 – 3, the folded flexible flap shown in FIGS. 4 – 8 functions to prevent the credit cards within the pockets from inadvertantly slipping out of the pockets and it functions to prevent undue abrasive wear of the cards. The folded flexible flap member 60' is also relatively economical to include in the manufacture of the billfold since the folded flap 60' is integrally attached to the back portion 20' of the pocket liner L' and can be inserted in the billfold or wallet with a minimum of manufacturing steps. Therefore, it is feasible to add the flexible flap without substantially increasing the cost of production of the wallet.

RESUMÉ

The present invention thus sets forth a billfold or wallet which includes a plurality of individual pockets for receiving credit cards in shingled relationship and also includes a flexible flap member which is designed to prevent abrasive wear of the portion of the credit cards projecting from the pockets and to prevent the credit cards from slipping out of the pockets. The arrangement and the manner in which the flexible flap is secured to the billfold allows it to be attached to the billfold during the manufacturing process without substantially increasing production costs.

I claim:

1. A multi-card billfold of the type for carrying a plurality of cards in shingled, and partially exposed relationship to one another, said billfold comprising at least one flexible wall having a plurality of parallel and spaced apart slits therein, a plurality of pockets disposed adjacent said flexible wall for receiving said cards through said slits in stacked, shingled relationship, and a flexible flap member secured along one edge to said flexible wall and liftably covering the front surface of said front flexible wall so as to cover cards projecting from said respective slits for securing said cards in said pockets.

2. The billfold of claim 1 including a second flexible wall defining an envelope-like opening with said one flexible wall, a generally rectangular and flat plastic pocket liner defining said plurality of pockets, said pocket liner being received in said envelope-like opening such that said pockets are aligned with said spaced apart slits.

3. The billfold set forth in claim 2, wherein said pocket liner includes a back member of heat sealable plastic having a generally rectangular shape and having a front side, a rear side and two opposite edges, a plurality of heat sealable plastic pocket members of generally rectangular shape and each having an upper edge, a lower edge, and opposite side edges, said pocket members being stacked in overlapping and shingled relationship against the front side of said back member, said pocket members and back member being heat sealed together to thereby form said pockets.

4. A billfold for carrying a plurality of cards in shingled, and partially exposed relationship to one another, said billfold comprising a front flexible wall secured to a back flexible wall to form an envelope-like opening therein, said front wall having a plurality of parallel and spaced apart slits cut therein, a generally rectangular and flat plastic pocket liner including a plurality of pockets disposed in said envelope-like opening and secured between said flexible walls for receiving said cards through said slits in stacked, shingled relationship, and a generally rectangular flexible flap member liftably covering the cards projecting from said slits.

5. The billfold of claim 4 wherein said flexible flap member is comprised of thin transparent plastic.

6. The billfold set forth in claim 5 wherein said flexible flap member includes a top edge secured to an edge of said front flexible wall by stitching and includes an opposite lower edge slidably receivable in one of said slits.

7. The billfold set forth in claim 5 wherein said flexible flap member is integrally connected to said pocket liner and is folded over said flexible wall to be slidably receivable in one of said slits.

8. The billfold set forth in claim 4, wherein said pocket liner comprises a back member of heat sealable plastic having a generally rectangular shape and having a front side, a rear side and two opposite edges, a plurality of heat sealable plastic pocket members of generally rectangular shape and each having an upper edge, a lower edge, and opposite side edges, said pocket members being stacked in overlapping and shingled relationship against the front side of said back member, said pocket members and back member being heat sealed together to thereby form said pockets and wherein said flexible flap member is integrally connected to said back member and overlaps said pockets for securing said cards therein and protecting them from abrasive wear.

9. The billfold set forth in claim 8, wherein said flexible flap member is heat sealed to the rear side of said back member and is folded over said back member and said pockets such that said pockets are disposed between said flexible flap member and said front side of the back member.

* * * * *